United States Patent [19]

Marchadour et al.

[11] Patent Number: 4,466,557

[45] Date of Patent: Aug. 21, 1984

[54] DEVICES FOR MEASURING THE QUANTITY OF PRODUCTS FOR CANNING

[76] Inventors: Yves Marchadour, Ker an Heol 80 route du Chaperon, St Evarzec, 29000 Quimper; Jean-Charles Marchadour, La feuilleraie Kerbascol, St Jean Trolimon, 29120 Pont l'Abbe, both of France

[21] Appl. No.: 353,921

[22] Filed: Mar. 2, 1982

[30] Foreign Application Priority Data

Mar. 4, 1981 [FR] France ..... 81 04350

[51] Int. Cl.[3] ..... B67D 5/60; G01F 11/00

[52] U.S. Cl. ..... 222/144; 222/275; 222/372

[58] Field of Search ..... 222/129, 216, 217, 221, 222/252, 255, 265, 275, 278, 372, 630, 144; 141/258, 259, 260, 261, 262, 144, 146

[56] References Cited

U.S. PATENT DOCUMENTS

| | | | |
|---|---|---|---|
| 2,166,528 | 7/1939 | Johannes | 222/439 X |
| 2,656,966 | 10/1953 | McDonough et al. | 222/217 X |
| 2,941,698 | 6/1960 | Fowler et al. | 222/216 |
| 3,227,320 | 1/1966 | Minder et al. | 222/216 X |
| 3,378,173 | 4/1968 | Minard | 222/255 X |
| 3,851,795 | 12/1974 | Anderson | 222/1 |
| 3,865,281 | 2/1975 | Byrd et al. | 222/252 |
| 4,076,482 | 2/1978 | Whetstone | 222/255 X |
| 4,341,329 | 7/1982 | Kuemmerer et al. | 222/275 |

*Primary Examiner*—Joseph J. Rolla
*Assistant Examiner*—Michael S. Huppert
*Attorney, Agent, or Firm*—Dennison, Meserole, Pollack & Scheiner

[57] ABSTRACT

Improvement to devices for measuring the quantity of products for canning comprising a quantity-measuring chamber which is substantially vertical and mounted on a support rotating about an axis substantially parallel to the axis of the chamber, the latter consisting of a tubular enclosure inside which slides a piston and having its lower part connected via a supply conduit, to a tank containing the product for canning and via a delivery conduit to a vertical cylindrical filling nozzle, in which slides a secondary piston, the delivery conduit issuing into the nozzle through a lateral opening entirely situated above the orifice by which the conduit communicates with the chamber. A controlled valve opens or closes a passage between at least the supply conduit and the measuring chamber. The delivery conduit is entirely situated inside the cylinder described by the axis of the measuring chamber during the rotation of the support. The invention finds an application in canning installations.

7 Claims, 6 Drawing Figures

DEVICES FOR MEASURING THE QUANTITY OF PRODUCTS FOR CANNING

The canning of semi-liquid, pasty or heteregeneous products such as jam containing lumps of fruit, animal foods with large lumps of meat, or foods for human consumption with lumps of meat or vegetables raises problems as to the control of quantity. Some of the machines known in the prior art comprise a plurality of measuring chambers mounted on a rotary support, each of said chambers comprising a cylinder and piston working as a pump. The chambers are generally arranged vertically. In this particular configuration, the upward stroke of the piston sucks the product through a supply conduit connected with a tank containing said product and generally placed in the center of said support, whereas the downward stroke of the piston delivers the product into the empty can through a delivery conduit. A valve selectively controls the closing or opening of the passage between the chamber and either of the aforesaid conduits.

The accurate measurement of the quantity required is dependent on a great number of factors. It is indeed related to the regularity of suction, to the nature of the product, to the effect of centrifugal force on the product when the machine turns and to the constancy of displacement (which itself depends of the constancy of the piston stroke and of its regularity over time). The regularity of suction is influenced by the presence or absence of residual air in the chamber or in the delivery conduit close to said chamber. It is also influenced by the cross-section of the suction channel whose dimensions must be such as to allow various-sized lumps of the product through, without however being so large as to be inconsistent with a given machine geometry. Said geometry is in fact imposed in particular by the size of the cans to be filled, which cans are brought substantially side by side under the rotating support so as to limit the linear speed of the production line to a maximum for a given output rate.

As to the centrifugal force, this acts to induce within said product a whole system of forces difficult to control which vectorially add to the controlled suction and delivery forces and randomly alter the conditions and characteristics thereof, such that the regularity of quantity control and of filling are also affected.

It is an object of the present invention to overcome the aforesaid disadvantages and to optimize the operation of this type of machine by providing an improvement consisting on the one hand, in eliminating as far as possible the presence of air which, by reacting as a resilient substance, occupies a volume which varies with the pressure conditions to which it is subjected, and on the other hand, in making positive and therefore controllable allowances for the effects of centrifugal force.

Accordingly, the present invention relates to an improvement in devices for controlling the quantity of products for canning, comprising a quantity-measuring chamber which is substantially vertical and mounted on a support rotating about an axis substantially parallel to the axis of said chamber, itself consisting of a tubular enclosure inside which slides a piston and having its lower part connected, via a supply conduit, to a tank containing the product for canning and via a delivery conduit to a vertical cylindrical filling nozzle, in which slides a secondary piston, said delivery conduit issuing into said nozzle through a lateral opening entirely situated above the orifice by which said conduit communicates with said chamber, a controlled valve opening or closing a passage between the supply conduit and the measuring chamber.

In one embodiment of the invention, said nozzle is located between the reservoir and said chamber, before the latter with respect to the direction of rotation of the support, the direction of said delivery conduit being substantially radial, whereas the supply conduit connecting said reservoir with said chamber has a part, adjacent to said reservoir, which is backwardly inclined with respect to said direction of rotation.

Also, in order to improve the filling qualities of the measuring chamber by reducing the obstacles to the flow of product, the aforesaid valve is formed by a bottom part of the measuring chamber, said part being mounted for rotation inside the tubular chamber by means of a cylindrical skirt with an opening operable to cover or uncover, depending on its position, at least the orifice through which the supply conduit issues into said chamber.

Moreover, the angular width of the opening of the said cylindrical skirt and the angular distance between the orifices through which the supply and delivery conduits issues into the bottom of said chamber are so dimensioned that when one of said openings is closed, the other is simultaneously opened as a result, thus isolating the measuring chamber during suction and preventing any reduction of pressure in the air that may be contained in the higher part of the delivery conduit.

In another embodiment of the invention, the filling nozzle comprises an inner rotary liner provided with an orifice, said orifice being designed to coincide with the side opening of the delivery conduit in the nozzle and to move with respect to said opening as the liner rotates to constitute means for gradually closing the delivery conduit. Said liner orifice is so designed as to comprise at least one edge which will cooperate during said rotation with said opening to gradually reduce the cross-section thereof whilst raising its threshold. In this case, the gradual closing of the opening by the liner is carried out during the last part of the delivery stroke of the quantity measuring piston and full closure is achieved immediately after said piston has reached its bottom dead center.

The invention will be more readily understood on reading the following description with reference to the accompanying drawings, in which.

Figure 1:
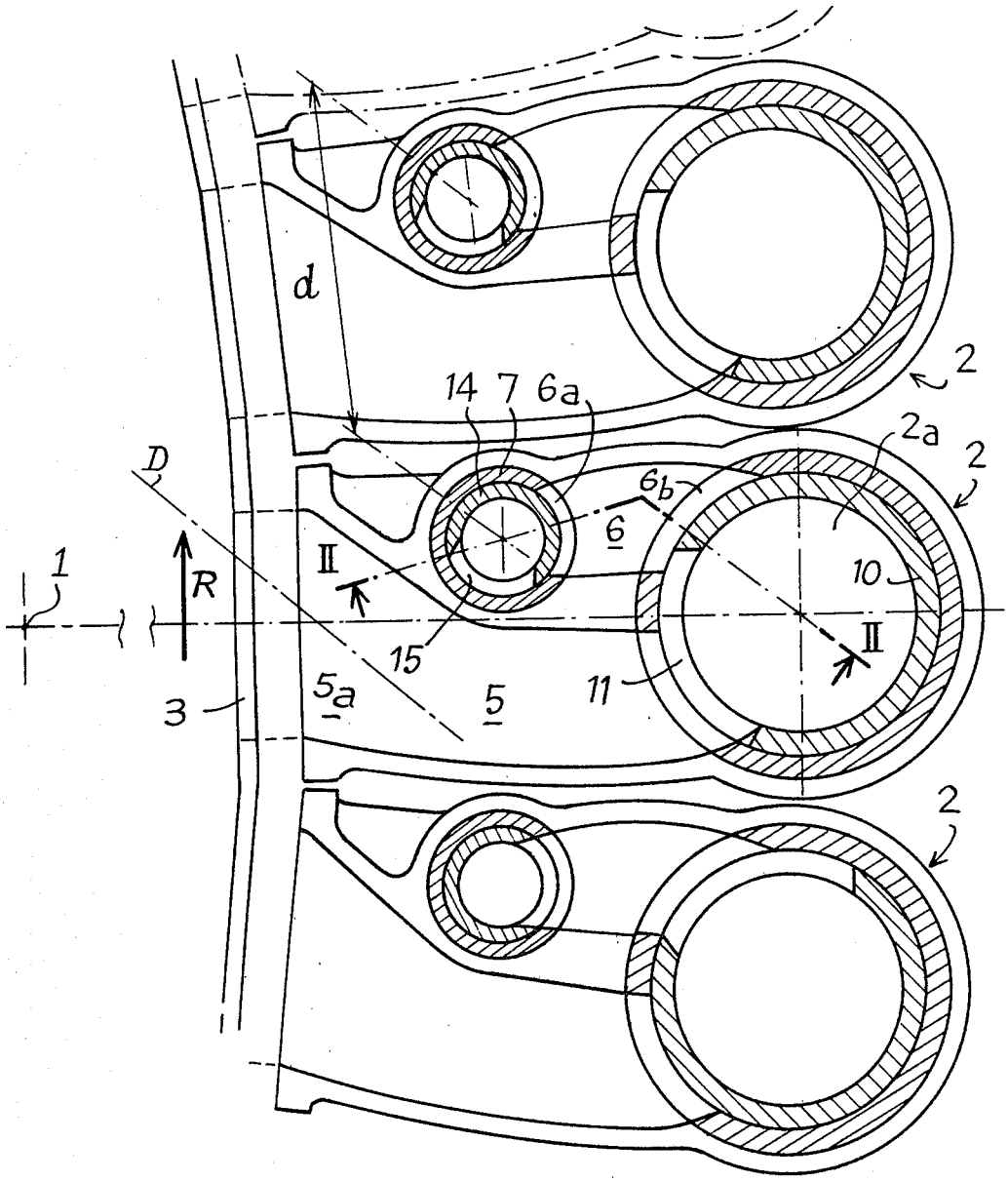
FIG. 1 is a partial view of a horizontal cross-section of a first embodiment of the improvement according to the invention.
Figure 2A:
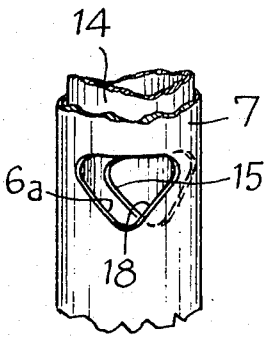
FIG. 2A is a partial view along F of a detail from FIG. 2.
Figure 2:
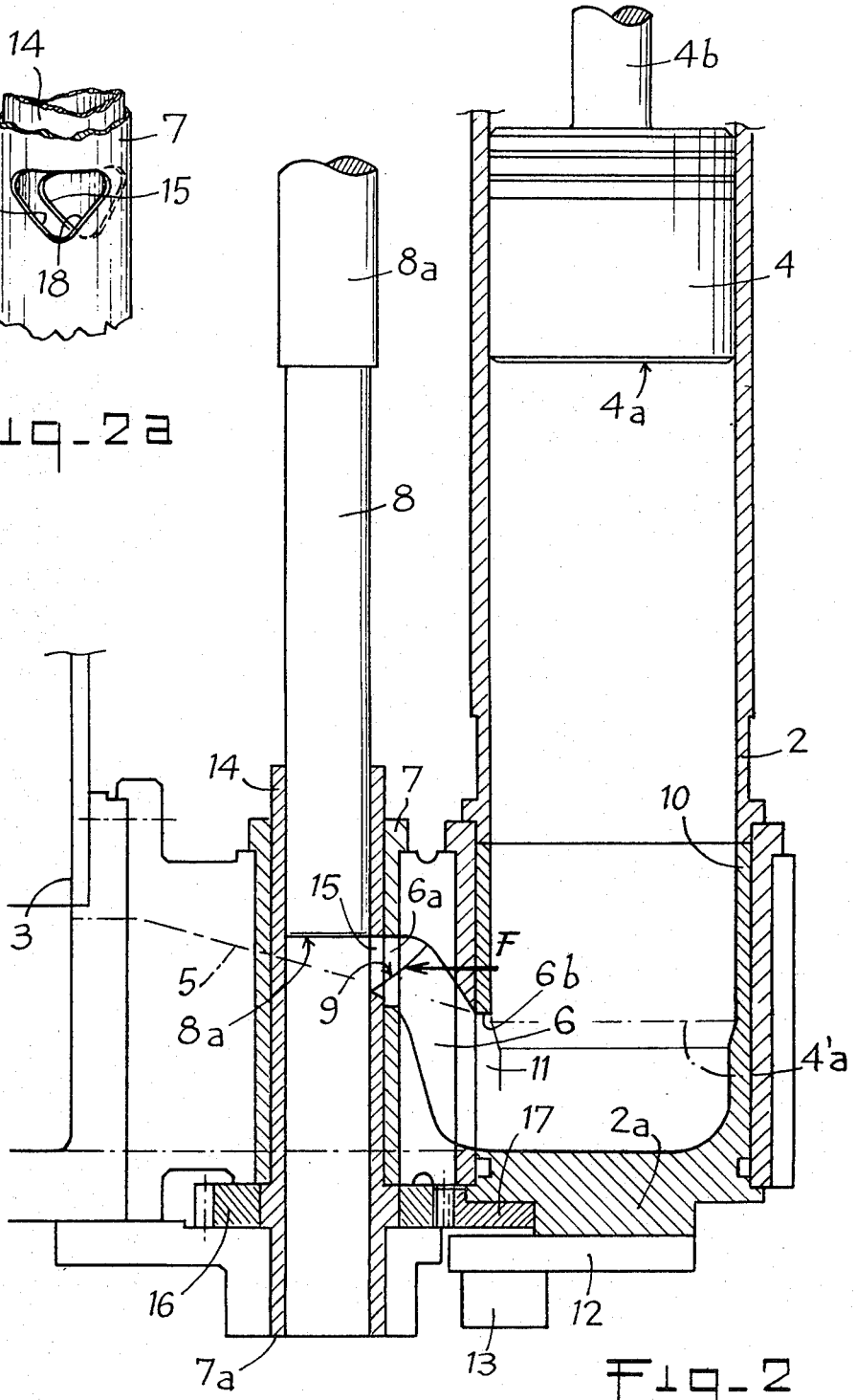
FIG. 2 is a cross-section along line II—II of FIG. 1, in which the movable elements used for closing the conduits are in another position.

Referring first to FIGS. 1 and 2, some of the elements of a prior art machine for controlling the quantity of products for canning are shown, said elements including a support rotating about a vertical axis 1, a plurality of quantity-measuring chambers 2, substantially vertical and integral with said support, and a central supply tank 3.

In each chamber 2—essentially a tubular enclosure—a piston 4 is operable to slide when actuated by a control mechanism to be described hereinafter. The bottom of said chamber 2, closed by a bottom piece 2*a*, can communicate with a supply conduit 5 and a delivery conduit 6, supplying and delivering the product for canning, in premeasured quantity. The supply conduit 5 starts from the reservoir 3, whereas the delivery conduit issues into a vertical, cylindrical nozzle 7 under the lower end 7*a* of which is placed the can to be filled. A secondary piston 8 or slide-valve is mounted for sliding in said nozzle between two positions, a low position in which its face 8*a* is contained in the end 7*a* of the nozzle, and a high position in which said piston face 8*a* is just level with the upper edge of the lateral opening 6*a* through which the conduit 6 issues into the nozzle 7. Moreover, said opening 6*a* is such that it is entirely above the orifice 6*b* through which the conduit 6 issues at the bottom of chamber 2 and a fortiori above the face 4*a* of piston 4 when the latter is at its bottom dead center, i.e. at end-of-delivery stroke or at start-of-suction stroke (shown in dashed and dotted line 4'*a* in FIG. 2).

Having reviewed the features of the prior art machine, a description of the improvements according to the invention will now be given. One of these improvements resides in the arrangement of the delivery conduit 6. It should be clear from the foregoing that in operation conduit 5, as well as the measuring chamber and conduit 6 contain the product for canning and that these components rotate about the axis 1.

Owing to the rotation of this assembly, the product is subjected to a not inconsiderable centrifugal force. The effect of this force follows the direction of filling from the measuring enclosure into the conduit 5. It should be noted that the part 5*a* of conduit 5 adjacent the tank or reservoir 3 has a general direction D (FIG. 1) which is backwardly inclined with respect to the direction of rotation R of the machine. This orientation considerably helps the penetration of the product, as it substantially corresponds to the direction of the resultant of the forces applied on the product in that area. It has been found that, in order to precisely control product delivery, it was necessary for said product to be delivered under the sole influence of the piston 4. Since it is impossible to eliminate the effect of centrifugal force, the delivery product has been placed in an area such that the centrifugal force is at least partly opposed by the delivery force. Thus, according to one of the characteristics of the invention, conduit 6 will be placed inside the cylinder described by the axis of chamber 2 about axis 1. Indeed, beyond that limit, the product inside the delivery conduit will tend to flow without the action of piston 4, due to centrifugal force, thus causing a spontaneous emptying of conduit 6 which, due to the configuration of the opening 6*a*, is siphon-shaped. The role of the centrifugal force in holding back the product will be used to best advantage if the conduit 6 is disposed as shown in FIG. 1, i.e. in a nearly radial direction (facing axis 1). The nozzle 7 will be advantageously placed before the axis of chamber 2 with respect to the direction of rotation R of the machine. Thus the conduit 6 will have a general direction approaching the radial direction although slightly inclined backwards to help the product return into the chamber 2 under the impetus of the forces generated by rotation. During delivery, piston 4 acts, as already indicated, against a resisting force, thus contributing as experience has shown, to good quantity control. In addition, one of the effects of the centrifugal force on the product contained in the conduit 6 according to the invention resides in the theoretically inclined conformation (see line 9 in FIG. 2) of the free surface of the product, close to opening 6*a*. As shown hereinafter, this inclination contributes to good quantity control, as it enables filling of conduit 6 (in the upper part of the siphon which it forms) which is inherently superior to that achieved with a product having a horizontal free surface.

The radial position of the delivery conduit such as shown in FIG. 1 increases the circumferential volume of each measuring head. The distance d between two successive nozzles is determined, on the one hand, to suit the radius of movement of the cans with the machine, which cannot go lower than a certain value without hindering their automatic conveyance and, on the other hand, to suit the width or the diameter of said cans. The distance d is slightly greater than the value of this diameter in order to have, for a given radius, a maximum number of cans under the head assembly of the machine. The space provided by said distance must be able to accomodate a suction conduit 5 and a delivery conduit having the largest possible cross-sections so as to allow product in chunk form (meat or fruit) to pass through whole. It is likewise important to avoid bottlenecks in these conveying conduits. The solution to all these problems, according to the invention resides in the design of the valve which causes the chamber 2 to communicate with the conduit 5 or to be isolated therefrom. Said valve consists of the bottom piece 2*a* which is mounted for rotating at the bottom of the tubular chamber 2. The upper part of said piece is a cylindrical skirt 10 with a side opening 11, which, depending on the angular position of said piece 2*a* is aligned with either the supply conduit 5 or the delivery conduit 6. As shown in FIG. 1, when said opening 11 clears conduit 5, conduit 6 is not completely sealed off. This particular arrangement may be advantageous, both in terms of avoiding shearing or jamming of certain parts of the product and in terms of helping the final filling phase. According to another embodiment of the invention, illustrated in FIG. 3, skirt 10 and side opening 11 provide complete opening and closing of conduit 6 during the closing and opening of conduit 5. The rotational operation of the valve thus constituted is controlled by a lever 12 provided with a runner 13 operable to cooperate during the machine's rotation about axis 1 with a fixed cam surface not shown in the FIG.

In order to isolate conduit 6 from the outside, especially at the end of the phase in which chamber 2 is filled, when the secondary piston 8 returns close to its top dead center position uncovering opening 6*a*, and in the case of FIG. 1, a rotary liner 14, provided with a side opening 15, has been placed in nozzle 7. Depending on the angular position of the said lining, the opening 15 is either aligned with opening 6*a* or located next to it, thus opening or closing the passage between the conduit 6 and the nozzle (open, in FIG. 2; closed in FIG. 1). The liner 14 is rotatively driven for example by the meshing of a toothed wheel 16 integral therewith and a segment gear 17 rotating with piece 2*a*. Thus the control of liner 14 is coupled with the control of valve 2*a*.

Finally, as shown in FIG. 2A which is an external view of the nozzle (according to F) at the level of opening 6a, the openings 6a and 15 are shaped so that their relative rotation will restrict the flow cross-section by raising its threshold 18. This particular disposition offers the following advantages :

When piston 4 is actuated downwards, flow becomes possible between the chamber and conduit 6 (with the concomittent closure of conduit 5) and the openings 6a and 15 become exactly aligned with one another. The product thus flows through conduit 6 into nozzle 7 for delivery into the can. At the end of delivery, valve 2a is set into rotation by the lever 12 without fully closing conduit 6, due to the angular width of opening 11 and, at the same time, liner 14 begins to rotate and to close opening 6a. A restriction of product flow thus occurs at this level which, due to the substantially constant rate of delivery at the other end of conduit 6, creates a slight overpressure in said conduit. The effect of this overpressure is to improve the filling of said conduit by confining any air which may be in the upper part of the siphon (substantially above line 9) in a smaller space and forcing it to pass, impelled by the product, above the threshold 18, now rising. When piston 4 reaches its bottom dead center (4'a), the opening 6a is nearly completely sealed off and piston 8 goes down into nozzle 7 to empty the product contained therein.

This succession of operations has made it possible to drain any air that may have been contained in conduit 6 and thus to create favorable conditions for a good suction. Indeed, when the measuring head is positioned as in FIG. 1, the upward return stroke of the piston 4 causes product to be sucked out of tank 3 through conduit 5. At the same time, the product contained in conduit 6 undergoes a reduction of pressure. Had any air been contained in the product, said air would have increased in volume and taken the place of the product, modifying the measured quantity by an uncontrolled value. This disadvantage is eliminated by the aforedescribed draining operation. It becomes thus possible to keep the measured quantity of product constant, with a fair amount of accuracy.

Figure 3:
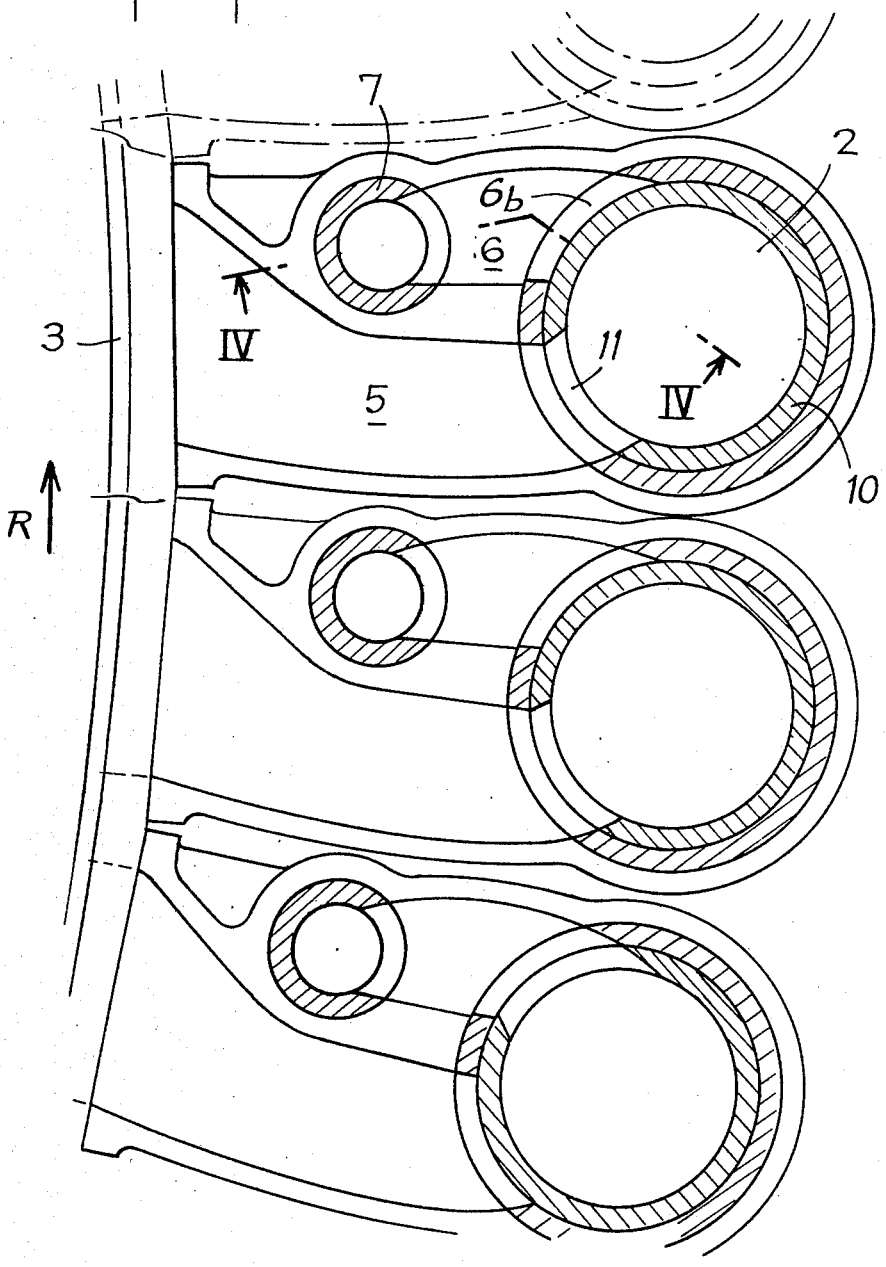
FIG. 3 shows another embodiment of the device shown in FIGS. 1 and 2.
Figure 4:
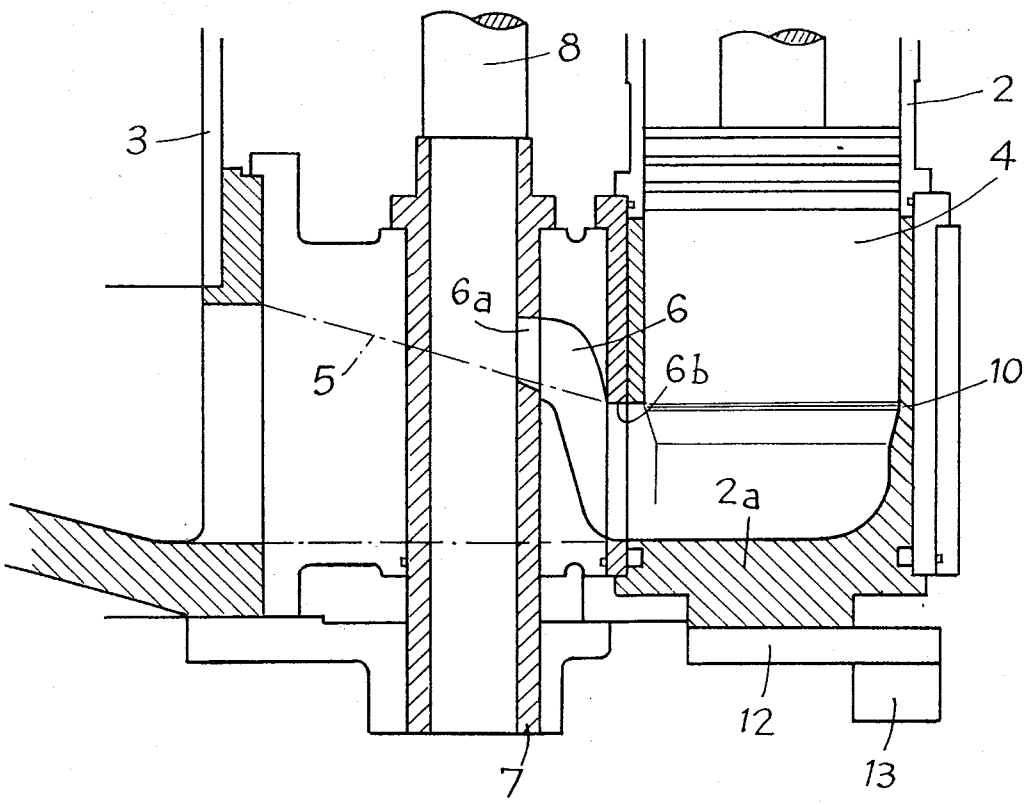
FIG. 4 is a cross-sectional view along line IV—IV of FIG. 3, of the apparatus in end-of-delivery position.

Referring now to FIGS. 3 and 4, in which like parts bear the same references as in previous figures, the nozzle 7 is no longer provided with a rotary liner and the skirt 10 of piece 2a is provided with an opening 11 which conicides with the outlets of conduits 5 and 6 into chamber 2. Thus, said conduits are respectively and selectively fully opened or closed by the valve 2a.

In the case of the embodiment of FIGS. 1 and 2 which comprises a rotary liner, said opening 6a is kept closed if there is no can under nozzle 7. Indeed, by known means, the operation of lever 12 is tied to the presence of a can. If no can is detected, the lever will not be actuated and chamber 2 remains in communication with the tank. There is then no need to keep the opening 6a closed by means of secondary piston 8 in the absence of a can. The control mechanism for piston 8 is thus simplified and said piston will work in an identical manner whether or not a can is present. This arrangement is especially advantageous when the machine has a high speed of rotation as it enables the use of a less-inclined guide-track control system (FIG. 5) for secondary piston 8.

For the purpose of the embodiment shown in FIGS. 3 and 4, wherein the operation of the secondary piston is not dependent on the presence or absence of a can, the opening 6a will be uncovered. However, given the way the conduits are oriented in accordance with the invention, the product is retained in conduit 6, except for a minimum loss which does not significantly affect the accuracy of the quantity measurement. It is possible, in the case of a slower machine rotation, to slave the operation of the secondary piston to the presence or absence of cans, thus maintaining the opening closed and eliminating any loss of product, however small.

Figure 5:
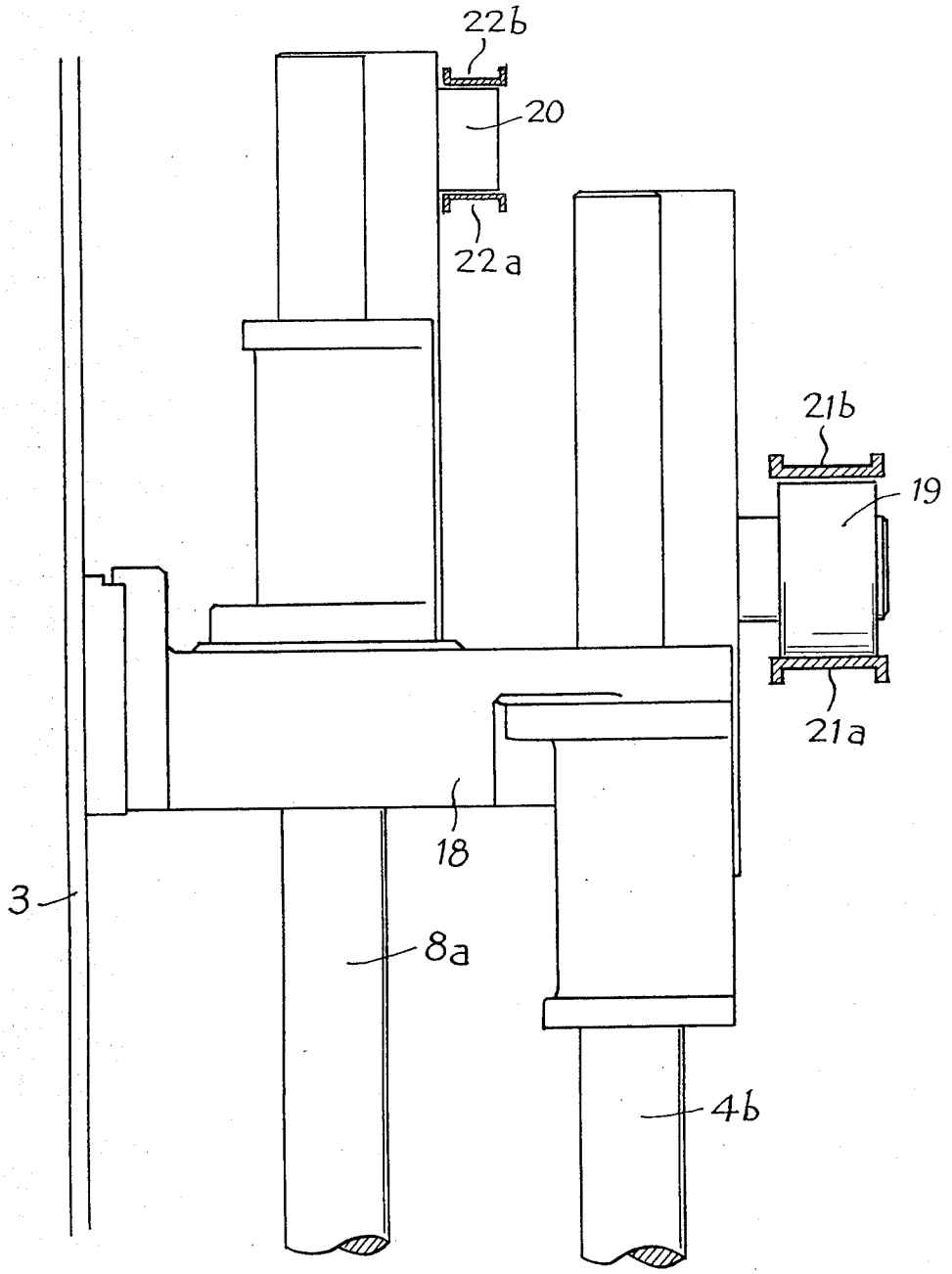
FIG. 5 is a partial view showing the control of the slide-valve or piston elements, in the machine improved according to the invention.

Referring now to FIG. 5 which diagrammatically illustrates the members controlling the above-mentioned pistons, said Figure shows the piston rods 8a and 4b of pistons 8 and 4 mounted for sliding in a support 18 integral with the central tank 3 and rotating therewith. Each one of said rods is laterally provided with a roller 19 and 20 operable to roll along a running path 21a, 21b, and 22a, 22b which is secured to a supporting structure forming part of the fixed frame of the machine. Said running paths thus constitute guides for said rollers and control the upward and downward strokes of pistons 4 and 8 through suitable slopes imparted to them during the rotation of the pistons about the axis of the machine. It is obvious that the paths 21a and 22a control the upward movement of the pistons, whereas the paths 21b and 22b control their downward movement.

These guides need only be given a profile adapted to the stroke, and to the speed desired for the pistons, to obtain a constant speed of rotation. Said guides can in fact be made in several sections to allow the adaptation of one or more parts of said guides to the kinematics required for said pistons, and even to allow the modification thereof.

The present inventin is in no way limited to the description given hereinabove and on the contrary covers any modifications that can be brought thereto without departing from the scope or the spirit thereof.

What is claimed is:

1. In apparatus for measuring the quantity of Products for canning; a supply tank to contain the products for canning, a quantity-measuring chamber with a substantially vertical axis, a support mounting said chamber for rotation in a predetermined direction about an axis substantially parallel to the axis of said chamber, said chamber comprising a tubular enclosure, a piston vertically reciprocal within said tubular enclosure, said chamber having a lower portion, a supply conduit communicating said lower portion of the chamber with the supply tank, a vertical cylindrical filling nozzle with a secondary piston reciprocal therein, a delivery conduit extending between the chamber and the nozzle, said delivery conduit communicating with said chamber through an orifice and communicating with said nozzle through a lateral opening entirely situated above the orifice by which said conduit communicates with said chamber, valve means controlling communication between the supply conduit and the measuring chamber, said nozzle being situated between the tank and the chamber and relatively forward of the chamber with respect to the direction of rotation of the chamber, said delivery conduit extending substantially radially, said supply conduit having a part, adjacent said tank, rearwardly inclined with respect to the direction of rotation.

2. The apparatus as claimed in claim 1, wherein said supply conduit communicates with the lower portion of the chamber through an orifice in said lower portion, said valve means comprising a bottom part of the measuring chamber rotatably mounted inside of said lower portion of that chamber and including a cylindrical skirt provided with an opening to selectively cover or uncover, depending on the rotational position of the bottom part and skirt, the orifice through which the supply conduit communicates with said lower portion and the interior of the chamber.

3. The apparatus as claimed in claim 2, wherein the angular width of the opening of said cylindrical skirt and the angular distance between the orifices through which the supply and delivery conduits communicate with the chamber are so dimensioned whereby when one of said orifices is closed, the other is simultaneously opened.

4. The apparatus as claimed in claim 1, wherein the filling nozzle comprises an inner rotary liner provided with an orifice alignable with the lateral opening communicating the delivery conduit with the nozzle and movable with respect to said lateral opening, upon rotation of the liner, for gradually closing communication with the delivery conduit.

5. The apparatus as claimed in claim 4, wherein said lateral opening defines a lower threshold, said liner orifice comprises at least an edge oriented whereby, during rotation of the liner relative to said lateral opening, there is a gradual upward raising of the lower threshold and a reduction in the effective size of the lateral opening.

6. The apparatus as claimed in claim 5, including means coordinating the gradual reducing of the effective size of the lateral opening by rotation of the liner with movement of the piston in the tubular enclosure of the quantitymeasuring chamber, said movement comprising a delivery stroke wherein this piston moves to a lower dead center position, the reduction in the size of the lateral opening occurring during the latter part of the delivery stroke with full closure being achieved after this piston has reached its lower dead center position.

7. The apparatus as claimed in claim 4, wherein said means coordinating gradual reducing of the effective size of the lateral opening comprises a toothed wheel mounted on said liner and a segment gear carried by the valve-forming rotary bottom part of the measuring chamber meshing with said toothed wheel.

* * * * *